United States Patent [19]

Aoyagi et al.

[11] Patent Number: 4,685,319

[45] Date of Patent: Aug. 11, 1987

[54] ROLLING METHOD AND APPARATUS FOR FORMING SECTIONS HAVING FLANGE

[75] Inventors: Koshiro Aoyagi; Taneharu Nishino; Kenji Betsuki, all of Kitakyushu, Japan

[73] Assignee: Nippon Steel Corporation, Tokyo, Japan

[21] Appl. No.: 693,267

[22] PCT Filed: May 4, 1984

[86] PCT No.: PCT/JP84/00226

§ 371 Date: Jan. 2, 1985

§ 102(e) Date: Jan. 2, 1985

[87] PCT Pub. No.: WO84/04263

PCT Pub. Date: Nov. 8, 1984

[30] Foreign Application Priority Data

May 4, 1983 [JP] Japan ..... 58-77391

[51] Int. Cl.[4] ..... B21B 1/08

[52] U.S. Cl. ..... 72/234; 72/177; 72/199; 72/225; 72/235; 72/366

[58] Field of Search ..... 72/234, 235, 225, 366, 72/177, 365, 199

[56] References Cited

U.S. PATENT DOCUMENTS

| | | | |
|---|---|---|---|
| 276,322 | 4/1883 | Acaster | 72/235 |
| 1,243,051 | 10/1917 | Dieter | 72/366 X |
| 2,361,729 | 10/1944 | Nedden et al. | 72/225 |
| 3,488,986 | 1/1970 | Stammbach | 72/366 X |

FOREIGN PATENT DOCUMENTS

| | | | |
|---|---|---|---|
| 53-84856 | 7/1978 | Japan . | |
| 0505447 | 3/1976 | U.S.S.R. | 72/366 |

*Primary Examiner*—Robert L. Spruill
*Assistant Examiner*—Steve Katz
*Attorney, Agent, or Firm*—Cushman, Darby & Cushman

[57] ABSTRACT

Rolling method and apparatus for forming sections having a flange connected to a web. Between two optional steps of roughing, intermediate rolling, and finishing steps, rolls 15, 15', 16, and 16' are arranged to expand the web in the widthwise direction. The rolls 15, 15', 16, and 16' fall in contact with the inner sides 21 and 22 of flanges. The rolls 15, 15', 16, and 16' may be engaged with the upper and lower faces of the web. The axes of the rolls 15, 15', 16, and 16' may be inclined at a predetermined angle θh in a direction horizontally rectangular to the rolling direction. It is preferred that the axes of the rolls 15, 15', 16, and 16' be vertically inclined at an angle θv to the horizontal plane.

14 Claims, 20 Drawing Figures

Fig. 1 (a) (PRIOR ART)
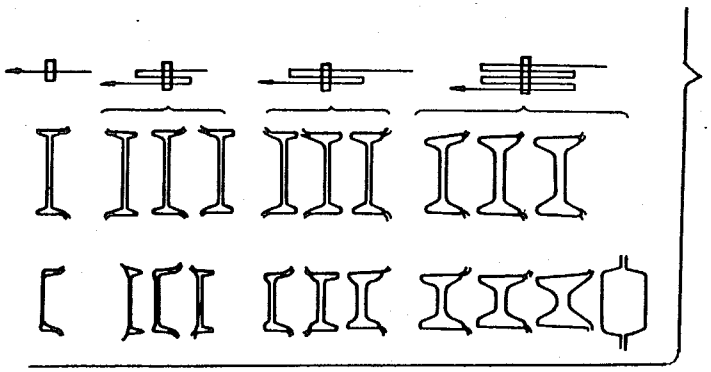
Fig. 1 (b) (PRIOR ART)
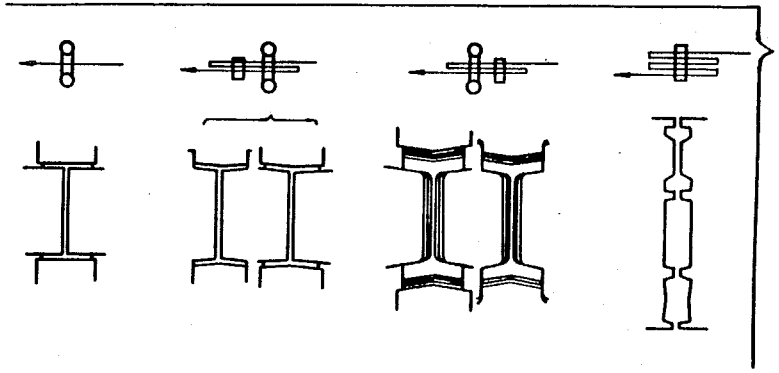

Fig. 1 (c) (PRIOR ART)
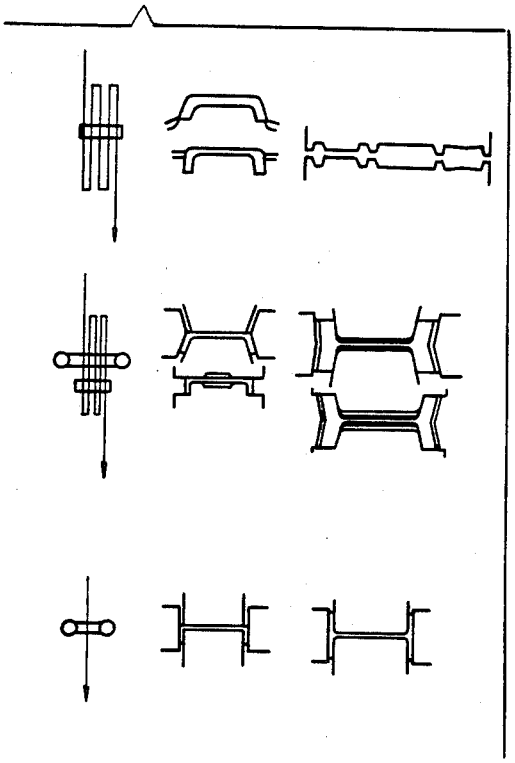
Fig. 1 (d) (PRIOR ART)
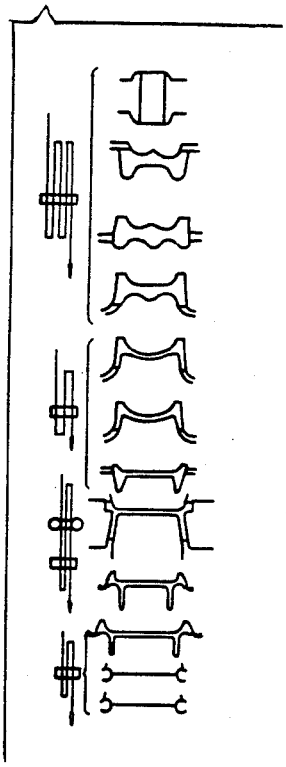

Fig. 2 (a) (PRIOR ART)
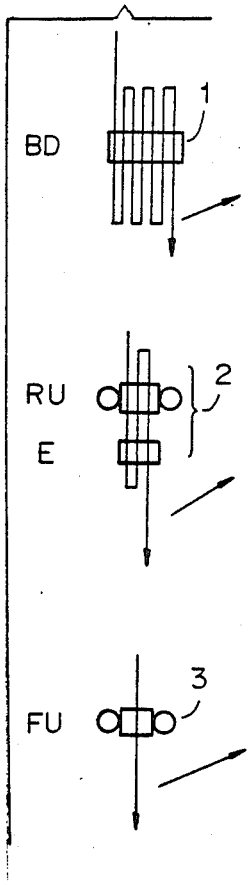
Fig. 2 (b) (PRIOR ART)
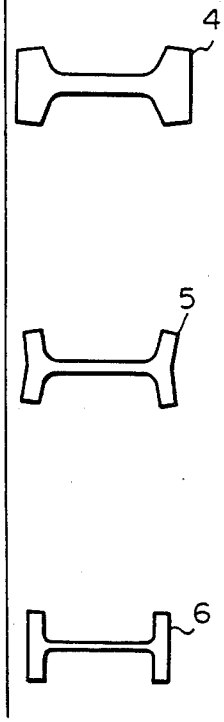
Fig. 3
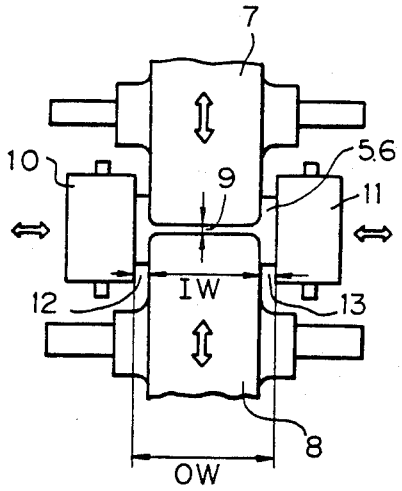

ROLLING METHOD AND APPARATUS FOR FORMING SECTIONS HAVING FLANGE

DESCRIPTION

1. Technical Field

The present invention relates to a rolling method and apparatus for forming sections having a flange, such as H-sections, channels, and other similar shapes.

2. Background Art

Sections of many varieties and sizes are now manufactured which differ greatly in kind, sectional shape, and dimensions. In order to manufacture a variety of sections differing in kind and size according to known rolling methods, it is necessary to set many rolls and accessory members according to the kinds and sizes of the sections. This causes the frequency of rolls-exchange to be increased, leading to a considerable time loss due to this exchange. FIG. 1 illustrates the arrangements of conventional rolling equipment rows, and the shapes of the grooves of the rolls attached to this rolling equipment. More specifically, FIG. 1-(*a*) shows an example in which two-high or three-high rolling mills are arranged from the roughing zone to the finishing zone, wherein I-beams and channels are formed by rolling, FIGS. 1-(*b*) and 1-(*c*) show examples in which two-high or three-high rolling mills are arranged in the roughing zone and universal rolling mills are arranged in the intermediate rolling and finishing zones, wherein H-beams and channels are formed by rolling, and FIG. 1-(*d*) shows an example in which two-high or three-high rolling mills and universal mills are appropriately arranged in the roughing, intermediate rolling and finishing zones, and straight web-type sheet piles are formed by rolling. In the conventional rolling method as shown in FIG. 1, exclusive rolls and accessory guides to be used from the roughing zone to the finishing zone should, in principle, be provided for the respective products independently, according to the kind and size of the products. Accordingly, as the sizes of the products are increased and the production range is broadened, the manufacturing costs are increased, and it becomes difficult to satisfy the needs of the customers in a simple way.

The above problem will now be described in detail taking the production of an H-beam as an example. Recently, production of so-called build-up H-beams through bonding and assembling steel sheets by welding has increased in line with the progress made in new welding techniques. This is because H-beams having optional sizes can be freely prepared according to customer needs. Typical products produced by this method are H-beams having a relatively small thickness and series of H-beams differing in flange thickness but having a constant web outer width.

H-Beams having a constant web outer width but differing in flange thickness are adapted for bonding and working operation when used in a beam construction. However, these H-beams are not prepared according to conventional rolling methods, for the following reasons.

FIG. 2-(*a*) shows a typical example of a conventional H-beam forming rolling equipment row, which comprises one breakdown rolling mill 1 (BD), a subsequent mill group 2 (RU-E) of a 4-roll universal rolling mill (RU) and an edger rolling mill (E), and a finishing 4-roll universal rolling mill 3 (FU).

FIG. 2-(*b*) shows shapes 4, 5, and 6 of rolled materials shaped by the rolling mills 1, 2 and 3, respectively. FIG. 3 shows the relationship between the rolls and the rolled materials in the universal rolling method for forming H-beams. Because of the functional limitations of the universal rolling mill, sizes that can be freely changed by a pair of rolls of the same set during the rolling operation are restricted to a gap 9 between upper and lower horizontal rolls 7 and 8 and gaps 12 and 13 between vertical rolls 10 and 11 and respective opposing sides of upper and lower horizontal rolls 7,8. Accordingly, the web thickness 9 and flange thicknesses 12 and 13 of the H-beam can be changed, but the inner width IW of the web must remain constant. Accordingly, where a series of H-beam products differing in web thickness 9 are prepared by rolling, if the left and right flange thicknesses 12 and 13 are changed, the outer width OW of the web corresponding to the sum of these flange thicknesses and web thickness will also be changed.

More specifically, as shown in FIG. 4, a series of H-beams prepared according to the conventional rolling method are produced with a constant inner width of the web in which the inner width IW of the web is constant and the outer widths OW1 and OW2 of the web are changed according to changes of the flange thicknesses Tf1 and Tf2, and it is very difficult for the conventional rolling method to prepare a series of products in which the outer width of the web is constant. In order to prepare a series of products having a constant outer width OW of the web according to the conventional rolling method using universal rolling mills, the majority of the upper and lower horizontal rolls used at the roughing, intermediate rolling, and finishing steps must be exchanged according to changes of the inner width of the web, and therefore, a large number of rolls must be prepared and the roll exchange operation be conducted very frequently.

Similar difficulties are observed in the production of sections having a flange other than H-beams. In the conventional rolling method, it is fundamentally difficult to provide rolls differing in size for respective lots of series of products of the same kind.

DISCLOSURE OF THE INVENTION

It is a primary object of the present invention to provide a rolling method and apparatus in which the above-mentioned defects of the conventional rolling method are eliminated and a variety of sections differing in size can be prepared independently at a high efficiency. Moreover, the present invention provides a rolling method and apparatus in which not only H-beams but also sections having, a flange other than H-beams, such as channels and sheet piles, differing in size can be prepared independently.

According to the present invention, at an optional step between the intermediate rolling step and the finishing rolling step, a roll falling in contact with the inner side of the flange of the material and having an axis inclined at a predetermined angle $\theta h$ to a direction horizontally rectangular to the rolling direction is arranged, and engagement of the roll with the flange and web causes the web to be expanded in the widthwise direction.

The roll may be arranged so that the roll falls in engagement with the upper and lower faces of the web.

The axis of the roll may be vertically inclined at a predetermined angle $\theta v$ to the horizontal plane. In this case, θv is in the range of from 0° to 30° and preferably smaller than 5°.

Furthermore, the above-mentioned angle θh is in the range of 0° to 50° and preferably smaller than 15°.

BRIEF DESCRIPTION OF THE DRAWINGS

FIG. 1 is a diagram of conventional rolling equipment rows and groove shapes of rolls of rolling mills for roughing, intermediate rolling and finishing zones;

FIG. 2 is a diagram of typical example of the conventional rolling equipment for forming H-beams, sectional shapes of materials rolled by roughing, intermediate and finishing rolling mills (BD), (RU-E), and (FU), and gives definitions of terms;

FIG. 3 is a diagram of the function of a universal rolling mill with reference to the relationship between a roll and a material rolled in the universal rolling method for forming H-beams;

BEST MODE FOR CARRYING OUT THE INVENTION

Figure 4:
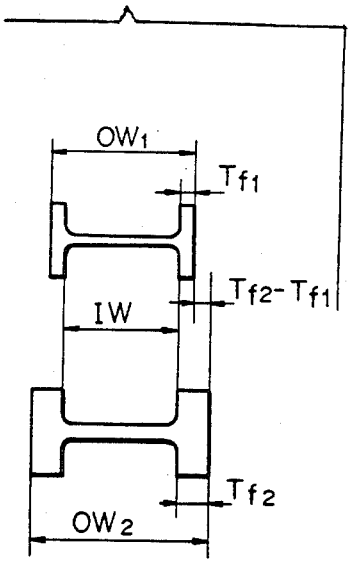
FIG. 4 is a diagram of changes of sectional shapes in a series of products having a constant inner width of the web according to one embodiment of the present invention, and gives definitions of terms.
Figure 5:
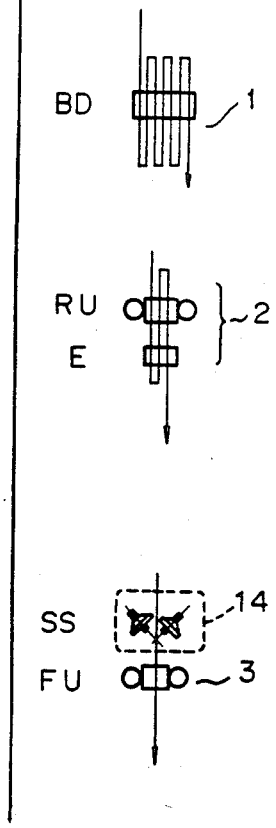
FIG. 5 is a diagram of an embodiment of a rolling equipment row in which sizing mills of the inclined roll system according to the present invention are arranged.

FIG. 5 shows an example of the rolling equipment row for the production of H-beams, in which reference numeral 14 represents an embodiment of a sizing mill of the inclined roll system. The function of this mill will now be described.

Figure 6:
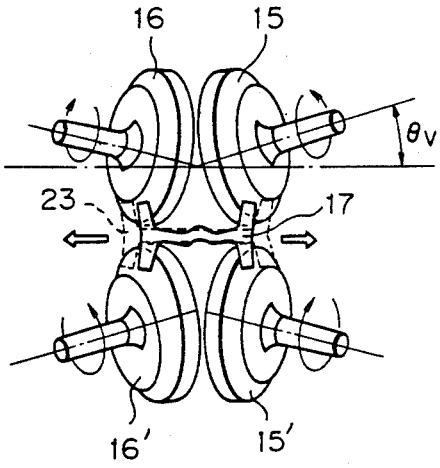
FIG. 6-(*a*) is a front view of the roll construction showing the mechanism and function of the present invention, and FIG. 6-(*b*) is a side view of the roll construction seen obliquely from above.
Figure 6:
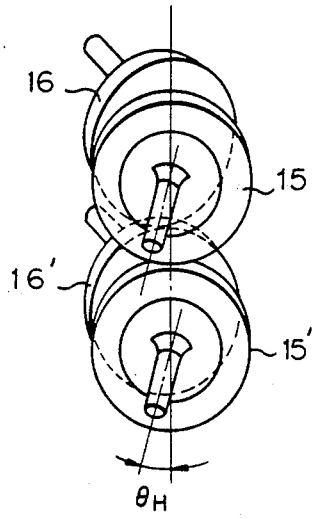

The structure and function of rolls attached to the sizing mill of the inclined roll system are diagrammatically shown in FIG. 6. The sizing mill of the inclined roll system according to the present invention is characterized in that, as shown in the front view (a) and the side view (b) seen obliquely from above, the sizing mill comprises two upper inclined rolls 15 and 16 and two lower inclined rolls 15' and 16'. As shown in FIG. 6-(*a*), an inclined roll falls in contact with a web portion close to a flange of a material 17 having an H-shaped section on the inlet side and the width of the web is expanded by an oblique force generated by pressure of the roll on the web portion. Simultaneously, the inner side face of the flange is expanded by the outer side face of the inclined roll to expand the width of the web. These two web width-expanding functions are exerted independently or synergistically, according to the quantity of expansion of the width of the web.

More specifically, since the roll axis can be freely changed three-dimensionally, as indicated by θh and θv in the drawings, according to the method of the present invention, an expanding force based on an oblique force is applied to the material to be rolled and expansion rolling is accomplished reasonably and efficiently.

Figure 7:
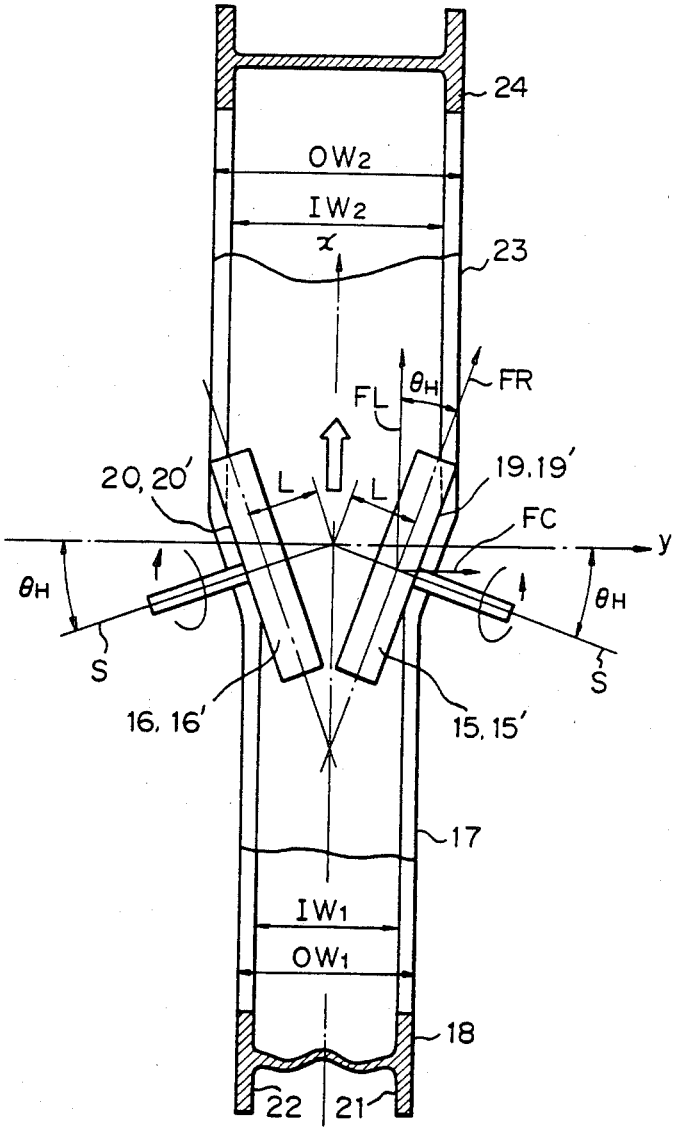
FIG. 7 is a plane view of one embodiment of a sizing mill of the inclined roll system according to the present invention, showing details of the function of the mill.

The rolling method of the present invention will now be described in detail with reference to FIGS. 7 and 8.

The structure of the sizing mill of the inclined roll system according to the present invention differs greatly from the structure of the conventional rolling mill for the production of sections. In most conventional rolling mills, the axes of the rolls are fixed so as to extend in a direction rectangular to the rolling direction. In the sizing mill of the present invention, as can be seen from the plane view of FIG. 7, the directions of the axes S of the left and right rolls are not rectangular to the direction of advance of the material but are inclined at an angle θh and are optionally changed. Namely, the left and right rolls are "inclined" in the form of "a wedge" to the direction of the material advance. In the present invention, these rolls are defined as inclined rolls. Furthermore, as shown in the front view of FIG. 8, the rolls may be parallel to the horizontal plane, or they may be inclined at an optional angle θv with respect to the horizontal plane.

The function of the mill of the present invention will now be described in detail with reference to one embodiment shown in the plane view of FIG. 7. Assuming that the central line of the advance direction of the inlet material 17 of the H-section is on an axis x and a direction rectangular thereto is on an axis y, the axes (driving shafts) S of the upper rolls 15 and 16 and the lower rolls 15' and 16' (not shown in the drawings but arranged in the mill mechanism) are inclined at an angle θh to the axis y. Rolls in this state are defined as inclined rolls and this mechanism is defined as the inclined roll system. When the inclined rolls 15, 15', 16, and 16' press a web of the material 17 on the inlet side having an H-shaped section 18 from above and below, a propelling force FR acting in a direction inclined at angle θh to the axis x is imposed on the web. As the result, the component FL of the propelling force FR acts as the force drawing the material into the advance direction and the component FC of the propelling force FR acts as the force expanding the web in a horizontal direction rectangular to the advance direction. This force FC is one element for expanding the inner side IW1 of the web in the widthwise direction.

The outer side faces 19, 19', 20, and 20' of the inclined rolls 15, 15', 16, and 16' fall in contact with the inner side faces 21 and 22 of the flange of the material 17 on the inlet side, whereby a force expanding the inner side face of the flange horizontally in a direction rectangular to the direction of the material advance is imposed. This expanding force is another element of expanding the inner width IW1 of the web.

The element of expanding the width of the web by pressing the web and the element of expanding the width of the web by acting on the flange exert their functions synergistically, whereby the web of the material to be rolled is easily and efficiently expanded. Namely, the inner width IW1 of the web of the material on the inlet side is expanded to IW2 in the material 23 on the outlet side and the outer width OW1 of the web is expanded to OW2, whereby an expanded H-shaped section 24 is formed.

In the conventional rolling method not adopting the inclined roll system, where $\theta h$ is equal to 0, if the web alone is pressed by the upper and lower horizontal rolls, the efficiency of expansion of the width of the web is low and the web is elongated in the rolling direction, while the flange not pressed is not elongated in the rolling direction. Therefore, an unbalance of the expansion between the web and flange is brought about, and a compressive stress acts on the web while a tensile stress acts on the flange. Therefore, waving is ordinarily caused in the web and it is difficult to obtain a good product. The reason for this difficulty in performing expansion of the web according to the conventional rolling method will now be described with reference to FIG. 9.

Figure 9:
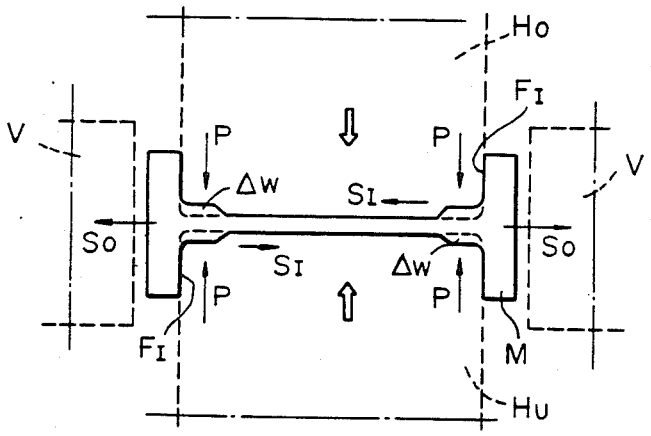
FIG. 9 is a front view showing the operation of expanding the web width of an H-beam according to the conventional rolling method, showing the problems arising when rolling is performed while expanding the web width.
Figure 9:
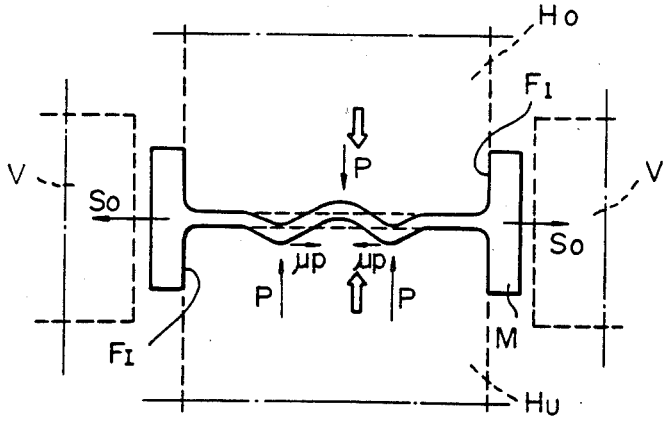

FIG. 9-(*a*) is a front view showing an example in which a material M to be rolled, which has a shape indicated by a solid line, is rolled according to the conventional rolling method while expanding the width of the web by pressing a part $\Delta w$ of the web. A metal flow deformation should be naturally caused in the part $\Delta W$ of the web to which a rolling force P is applied by the upper and lower horizontal rolls Ho and Hu. When the web is expanded by utilizing this metal flow deformation, (1) a metal flow is generated, not in the widthwise direction but in the direction of the material advance to be rolled, based on the propelling force transmitted from the roll only in the direction of the material advance, (2) a metal flow S1 is generated in the middle portion of the web, and (3) a metal flow So for expanding the width toward the exterior of the flange is generated.

Of these three metal flow deformations, each of the metal flows (1) and (2) exerts an elongating action only in the advance direction of the material to be rolled, and only the metal flow (3) exerts an action of expanding the width of the web in a direction rectangular to the advance direction of the material to be rolled. Therefore, an unbalance of elongation is caused between the web and the flange which is not elongated in the advance direction because it is not rolled, with the result that undesirable phenomena such as waving of the web are caused.

In contrast, in the case of the inclined roll system according to the present invention, by the action of the oblique force, a metal flow in the direction of expanding the width of the web is positively generated in the rolled part $\Delta w$ of the web, and therefore, the unbalance of elongation is drastically reduced between the flange and the web and expansion of the width of the web can be easily accomplished.

In the example, shown in FIG. 9-(*a*), of web-expanding rolling according to the conventional rolling method, rolling is started in the restrained state where the inner side face F1 is in contact with the outer faces of horizontal rolls Ho and Hu, but after the start of rolling, the inner side face F1 of the flange does not fall in contact with the side faces of the horizontal rolls and the flange is kept in the unrestrained free state. Accordingly, the size of the inner width of the web is unstable after expansion of the width.

In contrast, in the case of the inclined roll system according to the present invention, the restrained contact state can be maintained from the start of rolling to the end of rolling by the inclined faces of the rolls, and the size of the inner width of the web after expansion of the width is stable.

FIG. 9-(*b*) is a front view showing another example of expansion of the width of the web according to the conventional rolling method. In this method, as indicated by a solid line, a material having a bent web is provided so as to secure an allowance for expansion of the width in the web, and a rolling force P is supplied by the upper and lower horizontal rolls Ho and Hu of the conventional rolling sytem to expand the width of the web. In this method, (1) a frictional force $\mu P$ generated by the rolling force P acts as a force resistant against expansion of the width of the web while the bent portion of the web is rolled by applying the rolling force to the web by the upper and lower horizontal rolls Ho and Hu, and (2) the rolling is started in the restrained state where the inner side face F1 of the flange is kept in contact with the outer side faces of the horizontal rolls Ho and Hu, and then the inner side face F1 of the flange is not in contact with the side faces of the horizontal rolls and kept in the unrestrained free state until completion of the rolling. Accordingly, the same problems as described above with reference to the example shown in FIG. 9-(*a*) arise.

In contrast, according to the inclined roll system of the present invention, these problems are not caused because of the above-mentioned functions, and expansion of the width of the web can be performed smoothly.

FIG. 5 shows an example of a rolling equipment row for preparing a series of products of H-beams having a constant web outer width according to one embodiment of the present invention. Namely, the object of preparing H-beams having a constant web outer width is attained by arranging in combination an intermediate universal rolling mill (RU-E) 2, a sizing mill (SS) 14 of the inclined roll system, and a finishing rolling mill (FU) 3 as shown in FIG. 5.

An embodiment in which the present invention is applied to the production of a series of H-beam products having a constant web outer width of OW will now be described in detail with reference to FIG. 10.

Figure 10:
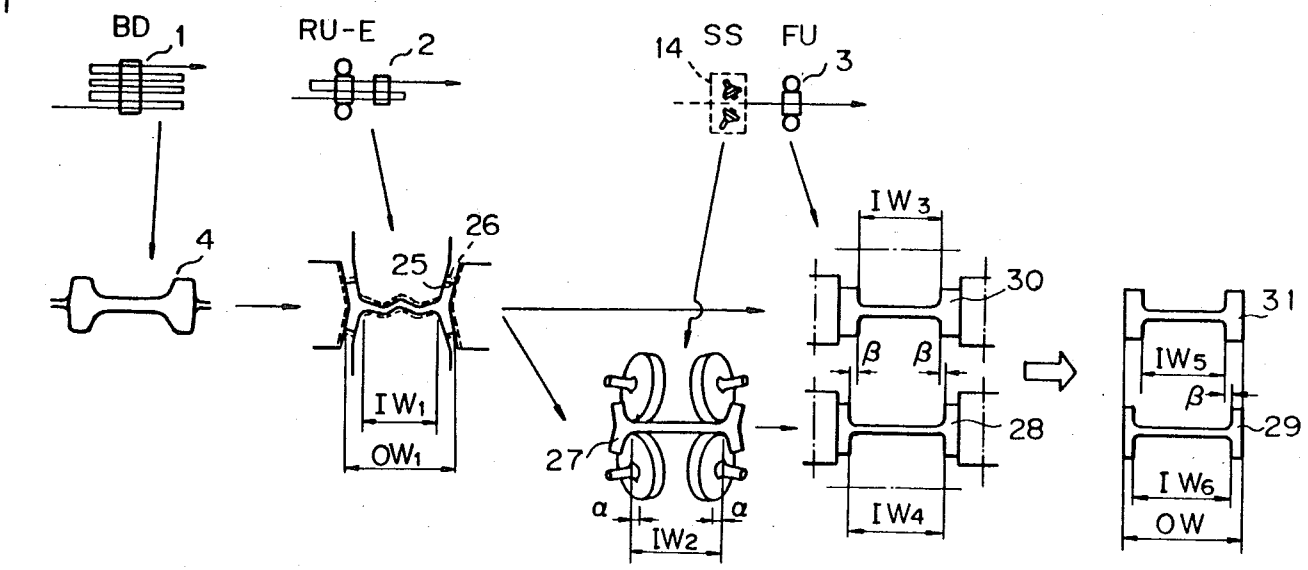
FIG. 10 is a diagram showing in detail an embodiment of the present invention in which H-beams having a constant outer width of the web are formed by rolling.

Specific functions of the intermediate universal rolling mill (RU-E) 2, the sizing mill (SS) 14 of the inclined roll system, and the finishing rolling mill (FU) 3 are shown in FIG. 10. In the intermediate universal rolling mill 2, forming is conducted to sectional shapes 25 and 26 while taking the flange thickness and web thickness of the final product and the inner widths IW5, IW6, . . . of the web into consideration, as shown in FIG. 10. The number of kinds of sectional shapes 25 and 26 thus formed is not particularly critical. Namely, since the material is rolled and shaped by the universal rolling mill at the intermediate rolling step, the web thickness and flange thickness can be freely changed, and a necessary number of different sectional shapes are formed according to the series of the product. However, the inner width IW1 of the web is constant, but the outer width OW1 of the web is not always constant.

The rolled material having the sectional shapes 25 and 26 formed by the intermediate universal rolling mill 2 or having other shaped sections differing in the web thickness and flange thickness is fed to the sizing mill 14 of the inclined roll system. The rolled material is formed into a rolled material 27 having a necessary expanded inner width IW2 of the web expanded and rolled according to the series of the products by the sizing mill 14.

For facilitating the illustration, it is supposed that the web width is expanded from IW1 to IW2 by the inclined rolls and the quantity of expansion of the web width necessary according to the product series $2\cdot\alpha$, which is expressed as follows:

$$2\cdot\alpha = IW2 - IW1$$

This quantity $2\alpha$ of expansion of the web width corresponds to the quantity $2\beta$ of the variation of the inner width of the web in the series of H-beam products having a constant outer width. Namely, based on the product 31 having a maximum flange thickness and a minimum inner width IW5 of the web among the series of the products, the double of the variation $\beta$ of the flange thickness is the variation $2\beta$ of the inner width of the web of the product as follows:

$$2\cdot\beta = IW6 - IW5$$

$$2\cdot\alpha \div 2\cdot\beta$$

What is important in the present embodiment of the present invention is that the quantity $2\cdot\alpha$ of necessary expansion of the web width varying according to the series of H-beam products having a constant outer width by the inclined rolls can be easily determined by adjusting (a) the inclination angle $\theta h$ of the inclined rolls, (b) the distance L between the left and right inclined rolls, and (c) the rolling reduction of the web.

Figure 11:
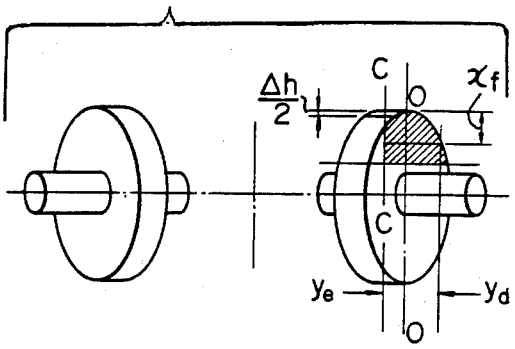
FIG. 11 is a diagram of an example of the calculation of conditions for expanding the web width of an H-beam in one embodiment of a sizing mill of the inclined roll system according to the present invention.
Figure 11:
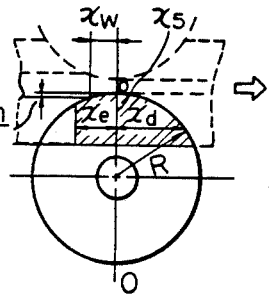
Figure 11:
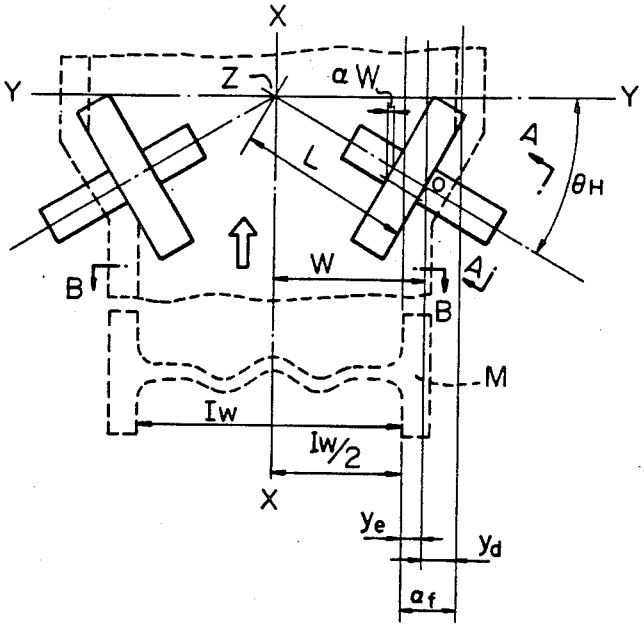

The rolled material 27 individually prepared by the sizing mill of the inclined roll system according to the present invention is shaped and rolled to a section 28 having an inner width I4 of the web varying according to the series of the products by the finishing rolling mill 3 and is formed into a product 29 having a constant outer width of the web and an inner width IW6 of the web varying according to the series of the products. A product 31 having a maximum flange thickness and a minimum inner width of the web among the series of the products can be prepared by adjusting the quantity of expansion of the web width by the inclined rolls to zero, and, as is seen from the section 30 of this product 31, the inner width IW3 of the web corresponds to the inner width IW5 of the web of the product and is set at a value conforming to the inner width IW1 of the web of the sections 25 and 26 formed by the intermediate universal rolling mill (RU-E) 2. An example of calculation of the width-expanding conditions according to the three factors, described hereinbefore, for adjusting the web width expansion quantity will now be described with reference to FIG. 11. FIG. 11-(*a*) is a plane view of the inclined roll, in which the shape M of the material to be rolled and the state of expansion of the web width are indicated by dot lines, FIG. 11-(*b*) is a front view of the inclined roll, and FIG. 11-(*c*) is a projection diagram of the inclined roll from the outer side face. Symbols of numerical values necessary for the calculation of the width-expanding conditions are shown in the drawings, and the definitions of these symbols are as follows.

IW: the inner width of the material to be rolled

L: the distance between the crossing point Z of the inclined rolls and the point 0 on the outer side face of the inclined roll, which is seen in the plane W: the distance between the central line X—X of the rolling direction of the material to be rolled and the inclined roll and the point 0 on the outer side face of the inclined roll, which is seen in the plane $\theta h$: the inclination angle of the inclined roll to the axis Y—Y rectangular to the rolling direction, which is seen in the plane xf: an optional distance in the direction of the flange width from the web face 0 on the outer side face of the inclined roll falling in contact with the inner side face of the material to be rolled, which is seen along the arrow A—A xe: the distance between the contact-starting line C—C and the central line 0—0 of the roll in the plane where the inclined roll falls in contact with the inner side face of the flange of the material to be rolled, which is seen along the arrow A—A xd: the distance between the central line 0—0 of the roll and the point of the termination of the contact in the plane where the inclined roll falls in contact with the inner side face of the flange of the material to be rolled, which is seen along the arrow A—A R: the radius of the inclined roll $\Delta h$: the rolling reduction of the web by the inclined rolls ($\frac{1}{2}$ of this rolling reduction is the rolling reduction $\Delta h/2$ by one inclined roll)

xw: the distance of the rolling-starting point and rolling-ending point 0 of the inclined roll falling in contact with the web of the material to be rolled, which is seen along the arrow A—A ye: the quantity of the displacement, in the direction of the axis Y—Y, of the inclined roll from the point of the start of the contact of the outer side face of the inclined roll with the inner side face of the material to be rolled to the center 0—0 of the outer side face of the roll, which is seen in the plane yd: the quantity of the displacement in the direction of the axis Y—Y from the center 0—0 of the outer side face of the roll to the point of the termination of the contact in the plane where the outer side face of the inclined roll falls in contact with the inner side face of the flange, which is seen in the plane $\alpha f$: the quantity of the displacement in the direction of the axis Y—Y from the start of the contact between the outer side face of the inclined roll and the inner side face of the flange of the material to be rolled to the point of the termination of the contact in the optional distance xf in the widthwise direction of the flange from the point 0 on the outer side face of the inclined roll, that is, the quantity of the distance where the outer side face of the inclined roll falls in contact with the inner side face of the flange of the material to be rolled to exert an expanding force on the web of the material to be rolled, which is seen along the arrow A—A $\Delta w$: the quantity of the displacement in the direction of the axis Y—Y from the start of rolling by the contact of the inclined roll with the web of the material to be rolled to the termination of rolling, that is, the quantity of the displacement where an oblique force generated by rolling of the web of the material to be rolled by the peripheral face of the inclined roll acts as an expanding force on the web of the material to be rolled in the width direction The following relationships are established among the foregoing symbols:

$$W = L \cdot \cos\theta_H \quad (1)$$

$$y_e = W - \frac{IW}{2} = L \cdot \cos\theta - IW/2$$

$$x_d = \sqrt{x_f \cdot (2 \cdot R - x_f)}$$

$$y_d = x_d \cdot \sin\theta_H$$

$$= \sqrt{x_f \cdot (2 \cdot R - x_f)} \cdot \sin\theta_H$$

$$\alpha_f = y_e + y_d$$

$$= L \cdot \cos\theta_H - \frac{IW}{2} + \sqrt{x_f \cdot (2 \cdot R - x_f)} \cdot \sin\theta_H$$

$$x_w = \sqrt{\Delta h/2 \cdot (2\,R - \Delta h/2)}$$

$$\alpha_w = x_w \cdot \sin\theta_H \quad (2)$$

$$= \sqrt{\Delta h/2 \cdot (2 \cdot R - \Delta h/2)} \cdot \sin\theta_H$$

The conditions for expanding the width of the web can be calculated according to the above formulae (1) and (2). As described hereinbefore with reference to the function of the mill, the two elements $\alpha f$ and $\alpha w$ for expanding the width of the web act synergistically, and hence, the web of the material to be rolled can be easily expanded. Furthermore, the quantity of expansion of the width of the web can be freely changed by adjusting the three factors L, $\theta h$ and $\Delta h/2$ as indicated by the formulae (1) and (2). Incidentally, the foregoing coefficients can be appropriately selected according to the rolling conditions.

Figure 8:
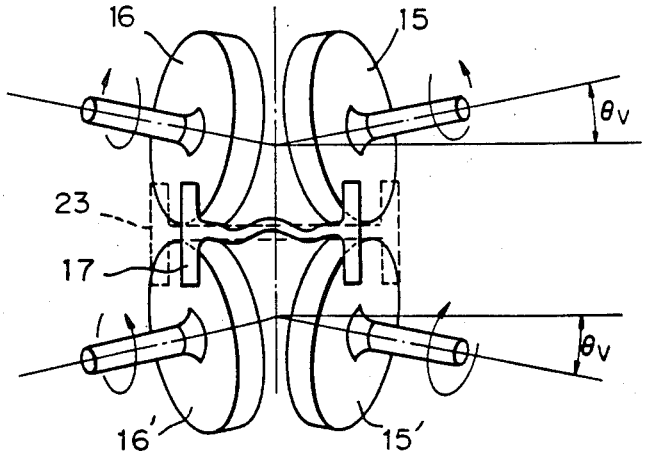
FIG. 8 is a front view of one embodiment of a sizing mill of the inclined roll system according to the present invention, showing the structure in which the axis of the inclined roll can be three-dimensionally changed.

Moreover, as shown in the front views of FIGS. 6 and 8, the axis of the inclined roll may be parallel to the horizontal plane, or may be inclined at an optional angle $\theta v$ to the horizontal plane. Although $\theta v$ is adjusted to 0 in the foregoing embodiment, the pattern of the face of the contact between the outer side face of the inclined roll and the inner side face of the flange of the material to be rolled can be controlled by appropriately adjusting the values of the inclination angles $\theta h$ and $\theta v$. For example, in the case of H-beams having a broad flange width, if the width-expanding action due to $\theta h$ alone is utilized, the difference of the displacement in the widthwise direction of the flange, that is, the difference of the displacement between the portion close to the web and the top end of the flange, is increased, and the shape of the material to be rolled is readily deformed. In this case, an appropriate shape can be obtained by appropriately setting the $\theta v$ vlaue. The $\theta h$ value is in the range of 0° to 50° and preferably smaller than 15°. The $\theta v$ value is in the range of 0° to 30° and preferably smaller than 5°.

In the foregoing embodiment, by forming various webs differing in width individually at the step preceding the finish rolling step, the preparation of large quantities of rolls and accessory members and the exchange thereof can be omitted. In order to obtain products having the desirable size and shape, it is preferred that in the finish rolling mill, horizontal rolls adapted for respective inner widths of webs be independently used for the products from the preceding step differing in the inner width of the web. However, if the change of the inner width of the web is small in the respective products, the same finishing rolls may be used for all the products, or an exchange of rolls can be omitted by using width-variable rolls as the finishing rolls.

The abrasion of the inclined rolls is not substantially different from the abrasion of rolls in the conventional rolling method, and even if certain abrasion is caused, the inclined rolls can resist a large quantity of rolling and be used for the production of a variety of products differing in size when the rolls are appropriately adjusted.

In the foregoing embodiment of the present invention, H-beams having a constant outer width are produced. Moreover, the present invention can be applied to the production of H-beams having a constant flange thickness but a varying outer width of the web, and two or three kinds of H-beams having a constant inner width of the web, which have heretofore been produced by mills, can be prepared individually without exchanging rolls and accessory members at the roughing and intermediate rolling steps. Thus, the application field of the present invention is very broad.

Figure 12:
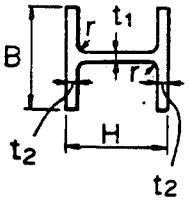
FIG. 12 is a diagram showing parts of a product, the sizes of which are shown in Table 1.

An example of the application range is shown in Table 1. Table 1-(*a*) shows some of the present standard sectional sizes stipulated in JIS, and Table 1-(*b*) shows an example of the application range. Note, the symbols in Table 1-(*a*) indicate the parts of the product shown in FIG. 12. In Table 1-(*a*), in a series of H-beam products having nominal sizes of 400×200 mm and 450×200 mm, the inner width of the web is constant. For the production of these products, different rolls and accessory members are provided for the roughing, intermediate rolling, and finishing steps, respectively. In Table 1-(*b*), there is shown an example of the application range of the rolling method using sizing mills of the inclined roll system, and it is demonstrated that if one set of rolls and accessory members are provided for each of the roughing and intermediate rolling steps, three kinds of H-beams differing in the size, that is, H-beams having a constant inner width of the web, H-beams having a constant outer width and H-beams having a novel intermediate size, can be prepared individually while maintaining the quality at the same level as in the conventional rolling method.

CAPABILITY OF EXPLOITATION IN INDUSTRY

As is apparent from the foregoing description, according to the rolling method for forming sections by inclined rolls according to the present invention, small quantities of a great variety of sections can be produced individually at a high efficiency, and the present invention provides an excellent technique sufficiently satisfying the present commercial needs diversed in a broad range.

The present invention has been described in detail mainly with reference to H-beams. Of course, the present invention can be applied to the production of other sections having a flange, such as channels, I-beams and sheet piles, by the web inner width-expanding rolling. Moreover, the present invention can be applied to the productions of sections of not only hot steel but also aluminum or the like.

TABLE 1-(a)

| Nominal Size (height × side) | JIS G-3192 Standard Sectional Size (mm) H × B | $t_1$ | $t_2$ | r |
|---|---|---|---|---|
| 400 × 200 | 396 × 199 | 7 | 11 | 16 |
| | 400 × 200 | 8 | 13 | 16 |
| 450 × 200 | 446 × 199 | 8 | 12 | 18 |
| | 450 × 200 | 9 | 14 | 18 |

TABLE 1-(b)

| Nominal Size (height × side) | Application Range Standard Size (mm) H × B | $t_1$ | $t_2$ | r | |
|---|---|---|---|---|---|
| 400 × 200 | o 396 × 199 | 7 | 11 | 16 | H-beams having |
| | 400 × 199 | 7 | 11 | 16 | constant outer |
| | o 400 × 200 | 8 | 13 | 16 | width |
| 425 × 200 | 421 × 199 | 7.5 | 11.5 | 17 | examples of novel |
| | 425 × 199 | 7.5 | 11.5 | 17 | intermediate size |
| | 425 × 200 | 8.5 | 13.5 | 17 | |
| 450 × 200 | o 466 × 199 | 8 | 12 | 18 | H-beams having |
| | 450 × 199 | 8 | 12 | 18 | constant outer |
| | o 450 × 200 | 9 | 14 | 18 | width |

Note Mark "o" indicates the conventional size.

We claim:

1. A method of using pairs or rolls for forming blanks, traveling along a linear path between the nip of each pair, into sections having a web connected to at least one edge flange, the step comprising:

between two optional steps of roughing, intermediate and finishing steps, wherein the axes of the roll pairs are parallel and lie in a plane perpendicular to the web transversely perpendicular to the path, engaging the inner side of the flange by a surface of revolution side face of one of a pair of short sizing rolls the axes of which lie in a common plane perpendicular to the web and inclined upstream of the path at a predetermined angle $\theta H$ greater than zero relative to the planes of the parallel roll pairs to exert a force to expand the web transversely of the path.

2. The method defined in claim 1 including engaging the opposite faces of the web by surface of revolution peripheral faces of the sizing rolls to also exert a force to expand the web transversely of the path.

3. The method defined in claim 1 including arranging the sizing rolls so that their axes diverge transversely of the path and so that each axis is inclined at the same predetermined angle $\theta V$ to the plane of the web.

4. The method defined in claim 3 wherein the angle $\theta v$ is less than 30°.

5. The method defined in claim 1, wherein the angle $\theta h$ is less than 50°.

6. The method defined in claim 1 including locating the sizing rolls between the rolls performing the intermediate step and the rolls performing the finishing step.

7. A sizing mill for forming blanks into sections having a web connected to at least one edge flange comprising:

means for advancing a blank having a web and an edge flange linearly along a path;

a pair of short sizing rolls positioned along said path for passage of an edge portion of the blank through the nip therebetween, said rolls having a surface of revolution peripheral face and a surface of revolution side face, said rolls being positioned to engage the inner side of the flange of the blank with said side face of one of said rolls and having axes lying in a common plane inclined upstream of the path at a predetermined angle $\theta H$ greater than zero relative to a plane transversely perpendicular to the path, whereby said rolls exert a force to expand the web transversely of said path.

8. The mill defined in claim 7 wherein the web has two flanges, one on each side, and including two pairs of sizing rolls, the rolls of one pair being positioned to engage the inner side of one of said flanges with the side face of one roll and the rolls of the other pair being positioned to engage the inner side of the other of said flanges with the side face of one roll.

9. The mill defined in claim 7 wherein the rolls are positioned to also engage the opposite faces of the web with their peripheral faces to exert another force to expand the web transversely of said path.

10. The mill defined in claim 8 wherein the rolls of each pair are positioned to also engage the opposite faces of the web with their peripheral faces to exert another force to expand the web transversely of said path.

11. The mill defined in claim 7 wherein the axes of the rolls diverge transversely of the path, each at the same predetermined angle $\theta v$ to the plane of the web.

12. The mill defined in claim 11 wherein the angle $\theta v$ is less than 30°.

13. The mill defined in claim 7 wherein the angle $\theta h$ is less than 50°.

14. The mill defined in claim 7 including pairs of rolls having a parallel axes positioned along the path for performing roughing, intermediate and finishing operations on the blank, and wherein the rolls of the sizing pair are located between said intermediate rolls and said finishing rolls.

* * * * *